US005344350A

United States Patent [19]

Hatch

[11] Patent Number: 5,344,350

[45] Date of Patent: Sep. 6, 1994

[54] COMPACT OUTBOARD MARINE DRIVE

[75] Inventor: Edwin B. Hatch, West Bend, Wis.

[73] Assignee: Brunswick Corporation, Skokie, Ill.

[21] Appl. No.: 9,356

[22] Filed: Jan. 26, 1993

Related U.S. Application Data

[63] Continuation of Ser. No. 839,320, Feb. 20, 1992, abandoned.

[51] Int. Cl.[5] ..... B63H 21/26

[52] U.S. Cl. ..... 440/78; 123/195 P; 440/900

[58] Field of Search ..... 440/75–78, 440/900; 123/195 P, 195 C

[56] References Cited

U.S. PATENT DOCUMENTS

| | | | |
|---|---|---|---|
| 3,025,822 | 3/1962 | Tenney | 440/900 |
| 3,692,006 | 9/1972 | Miller | 440/900 |
| 3,772,887 | 11/1973 | Ziegler | 440/900 |
| 3,911,853 | 10/1975 | Strang | 440/900 |
| 4,323,355 | 4/1982 | Kondo | 440/900 |
| 5,018,998 | 5/1991 | Kato | 440/900 |
| 5,069,643 | 12/1991 | Westberg | 440/900 |

*Primary Examiner*—Robert J. Oberleitner

*Assistant Examiner*—Clifford T. Bartz

*Attorney, Agent, or Firm*—Andrus, Sceales, Starke & Sawall

[57] ABSTRACT

An outboard marine drive (10) has a powerhead (20) including an internal combustion engine (22), an adaptor plate (24) mounted to the engine, and a lower gearcase (26) including a torpedo housing (28) rotatably mounting a propeller (30), wherein the lower gearcase is directly mounted to the adaptor plate without a driveshaft housing therebetween. An enclosing cowl (68) has left and right sidewalls (72 and 74), a back wall (76), and a top wall (78), and is open to the bottom (80) and open to the front (82) facing the boat. The adaptor plate is mounted to the bottom of the engine and closes the open bottom of the cowl in a horizontal plane, and the engine has left and right sides (84 and 86) closing the open front of the cowl in a vertical plane. The engine has a pair of upper and lower vertically spaced mounting arms (88 and 90) integrally cast with the engine crankcase (92) and extending forwardly toward the boat and journaled respectively to upper and lower ends (100 and 102) of a king pin (98) of a swivel bracket (94).

5 Claims, 2 Drawing Sheets

FIG. 2
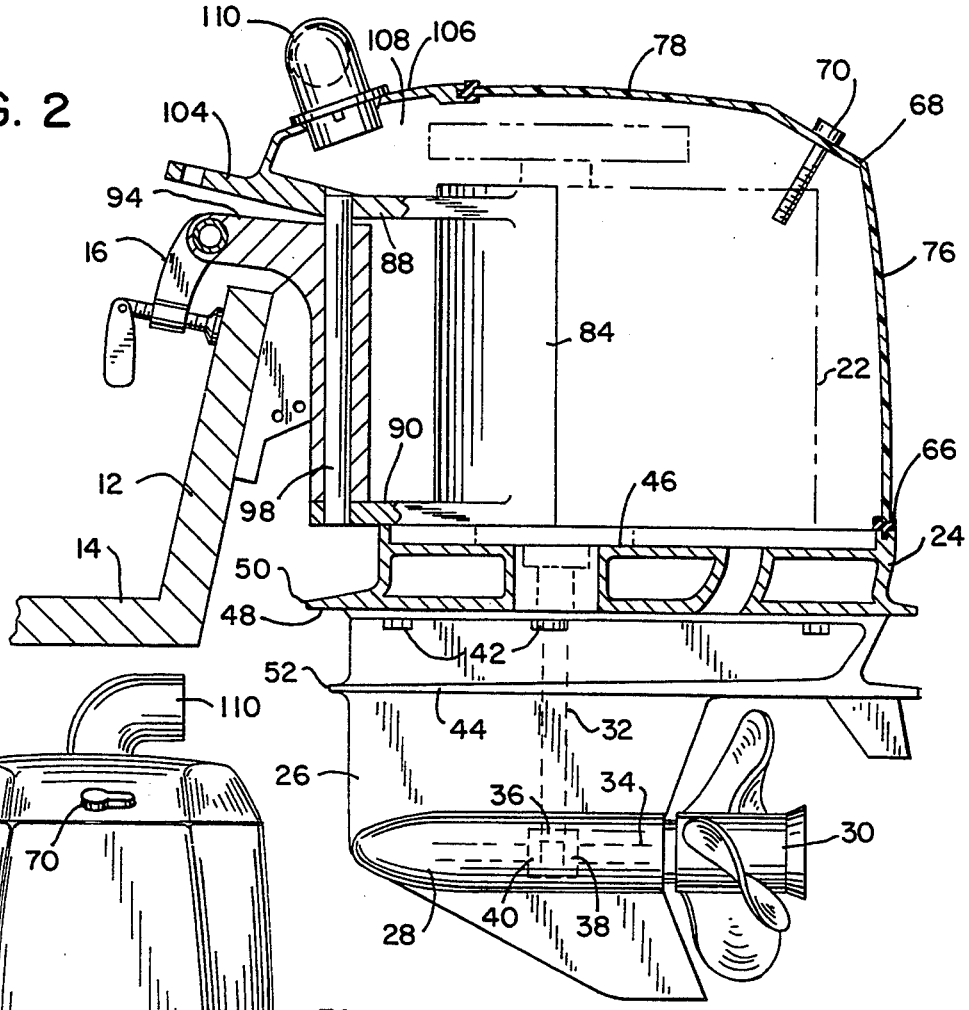
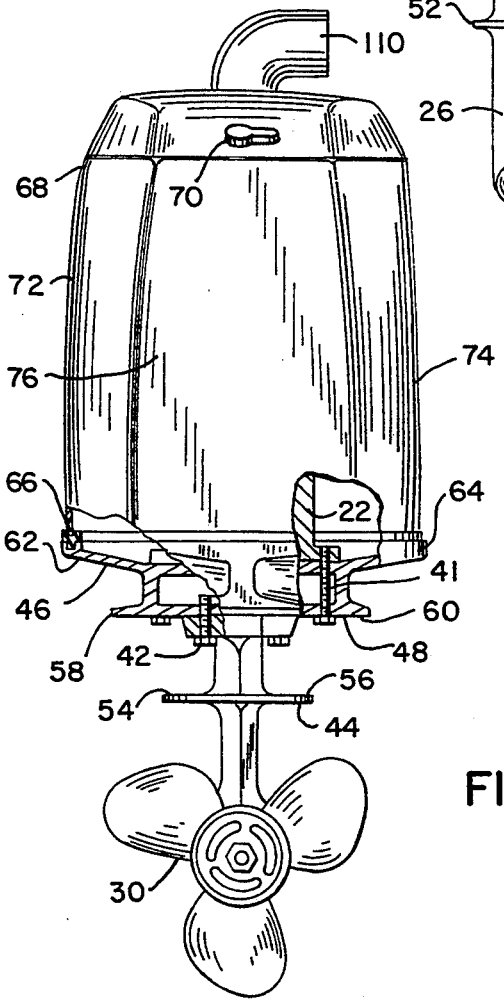
FIG. 3

COMPACT OUTBOARD MARINE DRIVE

BACKGROUND AND SUMMARY

This is a continuation of 07/839,320; now abandoned. The invention relates to outboard marine drives.

The invention provides a simplified, compact outboard marine drive. In one aspect, the invention provides a stubby, low profile outboard marine drive mountable to the transom of a boat by a transom bracket and tiltable about a horizontal tilt axis between a downwardly tilted normal drive position and an upwardly tilted position having minimal protrusion into the boat. The drive has minimal vertical height in the normal drive position. The drive includes a powerhead including an internal combustion engine, an adaptor plate mounted to the engine, and a lower gearcase including a torpedo housing rotatably mounting a propeller. The lower gearcase is directly mounted to the adaptor plate without a driveshaft housing therebetween.

In another aspect, the invention provides an outboard marine drive with an enclosing cowl having left and right sidewalls, a back wall, and a top wall, and being open to the bottom and open to the front facing the boat. An adaptor plate is mounted to the bottom of the engine and closes the open bottom of the cowl in a horizontal plane. The engine has left and right sides closing the open front of the cowl in a vertical plane.

In another aspect, the invention provides an outboard marine drive including a powerhead with an engine having a pair of upper and lower vertically spaced mounting arms integrally cast with the crankcase and extending forwardly toward the boat and journaled respectively to upper and lower ends of a king pin of a swivel bracket.

BRIEF DESCRIPTION OF THE DRAWINGS

FIG. 2 is a side view partially in section of the drive of FIG. 1.

FIG. 3 is a rear view of the drive of FIG. 2.

DETAILED DESCRIPTION

Figure 1:
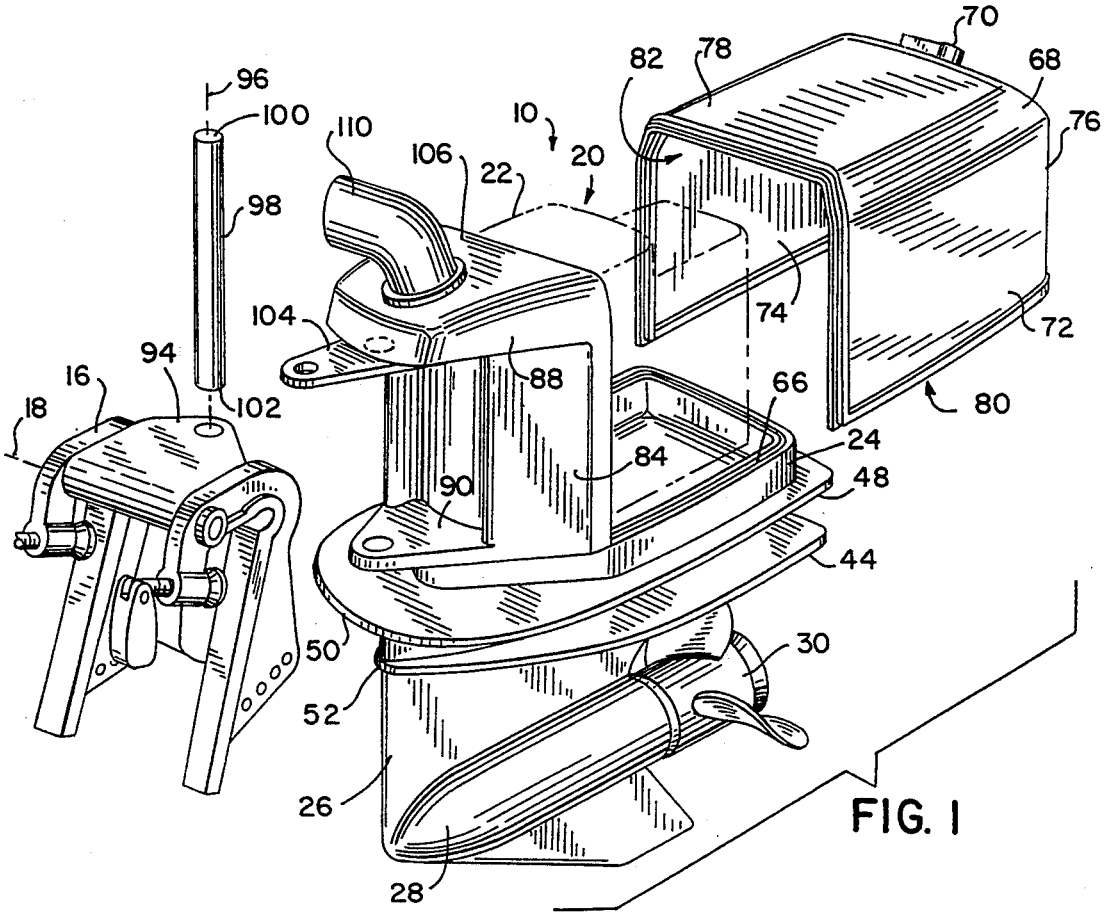
FIG. 1 is an exploded perspective view of an outboard marine drive in accordance with the invention.
Figure 4:
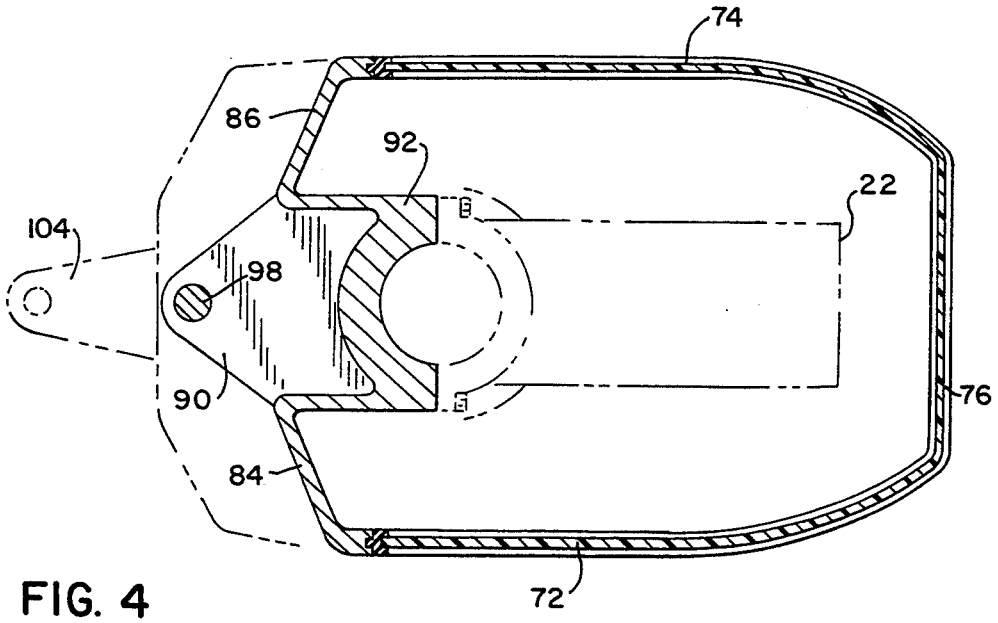
FIG. 4 is a horizontal sectional view of the drive of FIG. 2.

FIG. 1 shows a stubby outboard marine drive 10 mountable to the transom 12, FIG. 2, of a boat 14 by a transom bracket 16. The drive is tiltable about a horizontal tilt axis 18 between a downwardly tilted normal drive position, FIG. 2, and an upwardly tilted position having minimal protrusion into the boat. The drive has minimal vertical height in the normal drive position. The drive has a powerhead 20 including an internal combustion engine 22, an adaptor plate 24 mounted to the engine, and a lower gearcase 26 including a torpedo housing 28 rotatably mounting a propeller 30. The engine driveshaft 32 extends downwardly and drives propeller shaft 34 in known manner through a dog and clutch assembly having a driving pinion gear 36 at the bottom of driveshaft 32 and driving forward and reverse beveled gears 38 and 40 on propeller shaft 34, as is standard in the art. Adaptor plate 24 is bolted to engine 22 at bolts 41, FIG. 3, and lower gearcase 26 is bolted to adaptor plate 24 at bolts 42. Lower gearcase 26 is directly mounted to adaptor plate 24 without a driveshaft housing therebetween.

Lower gearcase 26 has a cavitation plate 44 extending laterally therefrom. Adaptor plate 24 has an upper surface 46 supporting the engine and a lower surface providing a splash plate 48 at the top of gearcase 26 and extending laterally therefrom and spaced above cavitation plate 44. Splash plate 48 extends forwardly at 50 toward the boat and beyond lower gearcase 26 and beyond forward leading edge 52 of cavitation plate 44. Splash plate 48 is about two to four inches above cavitation plate 44. Engine 22 is about two inches above splash plate 48. Cavitation plate 44 extends laterally left and right at left and right sides 54 and 56, FIG. 3. Splash plate 48 extends laterally left and right at 58 and 60 beyond cavitation plate 44. Upper surface 46 of adaptor plate 24 extends laterally left and right at 62 and 64 beyond splash plate 48.

The upper outer edge of the adaptor plate has a guide channel 66 therealong. Cowl 68 encloses powerhead 20 and is mounted and sealed to the adaptor plate along guide channel 66 and retained by mounting bolt 70. Cowl 68 has left and right sidewalls 72 and 74, a back wall 76, and a top wall 78. The cowl is open to the bottom at 80, and open to the front at 82 facing the boat. Adaptor plate 24 is mounted to the bottom of the engine and closes the open bottom of the cowl in a horizontal plane. The engine has left and right sides 84 and 86 closing the open front of the cowl in a vertical plane.

The engine has a pair of upper and lower vertically spaced mounting arms 88 and 90 integrally cast with the engine crankcase 92 and extending forwardly toward the boat. A swivel bracket 94 mounts the drive to transom bracket 16 for steering about a vertical steering axis 96 along a king pin 98 having upper and lower ends 100 and 102. Arms 88 and 90 are journaled respectively to upper and lower ends 100 and 102 of king pin 98. An upper arm 104 is provided on the engine for connection to a steering tiller arm. A rearwardly extending upper cover plate 106 seals top cowl wall 78 and defines an upper plenum 108 receiving combustion air through air inlet 110.

It is recognized that various equivalents, alternatives and modifications are possible within the scope of the appended claims.

I claim:

1. A stubby outboard marine drive mountable to the transom of a boat by a transom bracket and tiltable about a horizontal tilt axis between a downwardly tilted normal drive position and an upwardly tilted position having minimal protrusion into the boat, said drive having minimal vertical height in said normal drive position, said drive comprising a powerhead including an internal combustion engine, an adaptor plate directly mounted to said engine, a lower gearcase including a torpedo housing rotatably mounting a propeller, said lower gearcase being directly mounted to said adaptor plate, wherein said lower gearcase has a cavitation plate extending laterally therefrom, and said adaptor plate has an upper surface supporting said engine and a lower surface at the top of said lower gearcase and extending laterally therefrom, said lower surface of said adaptor plate providing a splash plate spaced above said cavitation plate, said upper surface of said adaptor plate being spaced below the top of the transom, said lower surface of said adaptor plate providing said splash plate being spaced slightly above the surface of the water and substantially below the top of the transom, wherein said cavitation plate extends laterally left and right, said lower surface of said adaptor plate providing said splash plate extends laterally left and right beyond said cavitation plate, and said upper surface of said adaptor plate extends laterally left and right beyond said splash plate.

2. The invention according to claim 1 wherein said splash plate formed by said lower surface of said adaptor plate extends forwardly toward the boat and beyond said lower gearcase and beyond said cavitation plate.

3. The invention according to claim 2 wherein said splash plate is about two to four inches above said cavitation plate, and said engine is about two inches above said splash plate.

4. A stubby outboard marine drive mountable to the transom of a boat by a transom bracket and tiltable about a horizontal tilt axis between a downwardly tilted normal drive position and an upwardly tilted position having minimal protrusion into the boat, said drive having minimal vertical height in said normal drive position, said drive comprising a powerhead including an internal combustion engine, an adaptor plate directly mounted to said engine, a lower gearcase directly mounted to said adaptor plate and having a torpedo housing rotatably mounting a propeller, said lower gearcase having a cavitation plate extending laterally therefrom, said adaptor plate having an upper surface supporting said engine and a lower surface at the top of said lower gearcase and extending laterally therefrom, said lower surface of said adaptor plate providing a splash plate spaced above said cavitation plate, said upper surface of said adaptor plate being spaced below the top of said transom, said lower surface of said adaptor plate providing said splash plate being spaced slightly above the surface of the water and substantially below the top of the transom, said lower gearcase being mounted to said adaptor plate by a first set of bolts extending through said lower surface of said adaptor plate providing said splash plate, said engine being mounted to said adaptor plate by a second set of bolts extending all the way through said adaptor plate including through said lower surface of said adaptor plate providing said splash plate.

5. The invention according to claim 4 wherein said cavitation plate extends laterally left and right, said lower surface of said adaptor plate providing said splash plate extends laterally left and right beyond said cavitation plate, said upper surface of said adaptor plate extends laterally left and right beyond said splash plate, said first set of bolts is substantially vertically aligned with said cavitation plate, said second set of bolts is laterally outward of said first set of bolts.

* * * * *